US008572800B2

(12) United States Patent
Haan

(10) Patent No.: US 8,572,800 B2
(45) Date of Patent: Nov. 5, 2013

(54) BASE ASSEMBLY FOR SWEEPER

(75) Inventor: Gyung-hee Haan, Seoul (KR)

(73) Assignee: HAAN Corporation, Seoul (KR)

( * ) Notice: Subject to any disclaimer, the term of this patent is extended or adjusted under 35 U.S.C. 154(b) by 423 days.

(21) Appl. No.: 12/927,530

(22) Filed: Nov. 16, 2010

(65) Prior Publication Data

US 2011/0107528 A1 May 12, 2011

(30) Foreign Application Priority Data

Nov. 12, 2009 (KR) ..... 10-2009-0109104
Nov. 12, 2009 (KR) ..... 10-2009-0109105
Dec. 1, 2009 (KR) ..... 10-2009-0117788

(51) Int. Cl.
*A47L 11/30* (2006.01)

(52) U.S. Cl.
USPC ..... 15/320; 15/364; 15/383; 15/403; 15/41.1; 15/49.1; 15/98

(58) Field of Classification Search
USPC ..... 15/320, 364, 383, 403, 41.1, 49.1–51, 15/98
IPC ..... A47L 11/30
See application file for complete search history.

(56) References Cited

U.S. PATENT DOCUMENTS

| | | | | |
|---|---|---|---|---|
| 2,235,432 | A | 3/1941 | Kenyon | |
| 8,240,002 | B2 * | 8/2012 | Haan | 15/387 |
| 2010/0236018 | A1 * | 9/2010 | Vrdoljak et al. | 15/412 |

FOREIGN PATENT DOCUMENTS

| | | |
|---|---|---|
| GB | 474772 | 11/1937 |
| GB | 504728 | 4/1939 |
| GB | 638383 | 6/1950 |
| GB | 1255127 | 11/1971 |
| JP | 51-15569 | 2/1976 |
| JP | 51-18473 | 2/1976 |

* cited by examiner

*Primary Examiner* — David Redding
(74) *Attorney, Agent, or Firm* — Zuber Lawler & Del Duca LLP

(57) ABSTRACT

A floor cleaner has a base assembly which comprises a body composed of an upper casing and a lower casing, a sweeping member mounted on the front side of the body, a steam generating member mounted at the rear side of the body, a pad tray with protrusions formed thereon to which a pad is attached, the protrusions made of a material that is softer than the material of the pad tray, and an attachment/detachment member that attaches and detaches the pad tray to and from the bottom face of the lower casing.

6 Claims, 18 Drawing Sheets

BASE ASSEMBLY FOR SWEEPER

BACKGROUND OF THE INVENTION

1. Field of the Invention

The present invention relates to a sweeper, and in particular, to a dust case for a sweeper.

2. Description of the Prior Art

A conventional sweeper is disclosed, for example, in Korean Official Gazette for Registration Utility Model 20-0317923. Referring to FIGS. 14 and 15, the sweeper according to this disclosure includes a housing 10, a rotary brush 20 installed in a manner rotable by a drive motor 30 installed at one side of the housing 10, a container 40 removably installed at the rear side of the housing 10, and a handle (not shown) removably connected to an upper side face of the housing 10. The housing 10 has a suction port of a given size on the front lower side, and the rotary brush 20 is disposed at the suction port 11. There is a coupling groove 12 formed at a rear side of the housing 10, and a turnable piece 13 into which the handle (not shown) is inserted and installed at an upper side of the housing 10.

The rotary brush 20 is disposed at the side of the suction port 11 of the housing 10 and installed in such a manner that a part of it is exposed outside the housing 10 and contacts the floor surface. Also, the rotary brush 20 is configured to receive a rotational driving force from the drive motor which is provided at one side of the housing 10, via an indirect transmission mechanism 32 (such as a belt, chain, etc.). Here, the drive motor 30 is actuated in response to an On/Off signal from an actuating switch 31 provided on an upper side face of the housing 10.

The container 40 is removably connected to the rear side of the housing 10, and a hook 42 that is opened either upwards or downwards by a push button 41 is preferably formed on a front side of the container 42, the hook 42 being linked into or released (pulled out) from the coupling groove 12 that is formed at the rear side face of the housing 10 to enable the installation/removal of the container 40 at/from the rear side of the housing 10.

Moreover, a predetermined guide groove 15 or guide projection 43 is selectively formed at a region where the housing 10 and the container 40 are interconnected to each other, and an appropriate number of wheels are provided at the lower faces of the housing 10 and container 40. Tilt planes 14 and 44 of a predetermined angle are formed at the lower face of the region where the housing 10 and the container 40 are interconnected to each other to ensure that dirt particles on the floor surface being collected by the rotary brush 20 are completely gathered into the container 40.

According to this configuration of the housing 10 and the container 40 of a conventional sweeper, dirt particles when swept by the rotary brush 20 usually move along the tilt plane 14 and are collected in the container 40, but some dirt particles flow reversely because of the centrifugal force of the rotary brush 20 and may escape again through the suction port 11.

Furthermore, when dirt particles become stuck to the rotary brush 20, the performance of the rotary brush as a broom is degraded, and the sanitary appearance thereof is affected.

Referring now to FIGS. 16 and 17, a conventional steam combined sweeper includes a built-in tank 10*x* where water is kept and boiled into steam to generate water vapor, a wheel 20*x* for moving a body 30*x* and a suction brush 40*x* located at the front area of the body 30*x* to sweep dirt on the floor, in which a cleaning cloth 50*x* is removably attached to the bottom face of the body 30*x*, the suction brush 40*x* is coupled to the body 30*x* in a rotatable manner by a shaft support 42*x* disposed transversely, and one side of the shaft support 42*x* is connected to the wheel 20*x* and to a belt 60*x* to enable rotation. Steam being generated is spouted through steam-spouting holes 12*x* so as to dampen the cleaning cloth 50*x* attached to the body 30*x*.

Meanwhile, when the conventional sweeper described above is used for cleaning a carpet (e.g., a fur carpet), projections used for attaching the cloth 50*x* may be caught in furs of the carpet and cause damage to the carpet, meaning that the sweeper is suitable only for cleaning non-carpeted floors.

SUMMARY OF THE DISCLOSURE

It is one objective of the present invention to provide a base assembly for a floor cleaner that is capable of preventing overall warping while maintaining the function of the pad attachment protrusions.

To accomplish these objectives, the present invention provides a floor cleaner having a base assembly. The base assembly comprises a body composed of an upper casing and a lower casing, a sweeping member mounted on the front side of the body, a steam generating member mounted at the rear side of the body, a pad tray with protrusions formed thereon to which a pad is attached, the protrusions made of a material that is softer than the material of the pad tray, and an attachment/detachment member that attaches and detaches the pad tray to and from the bottom face of the lower casing.

By inserting a first tray board with soft protrusions formed thereon to mold a second hard tray board, it becomes possible to prevent overall warping while maintaining the function of the pad attachment protrusions as a single product.

In addition, the attachment/detachment member is composed of a first attachment/detachment portion protruding from the pad tray so as to form a locking groove on a lateral face, and a second attachment/detachment portion mounted in a recess on the bottom face of the lower casing and then locked into the locking groove, wherein the second attachment/detachment portion includes an elastic locking element received by the recess and locked into the locking groove, and a support element fastened to the lower casing to support the elastic locking element such that the assembly/disassembly can be facilitated and the function of the elastic locking element can be securely maintained.

BRIEF DESCRIPTION OF THE DRAWINGS

FIG. 6A is an assembled bottom perspective view of the upper casing of FIG. 6A.

DETAILED DESCRIPTION OF THE PREFERRED EMBODIMENTS

Figure 1:
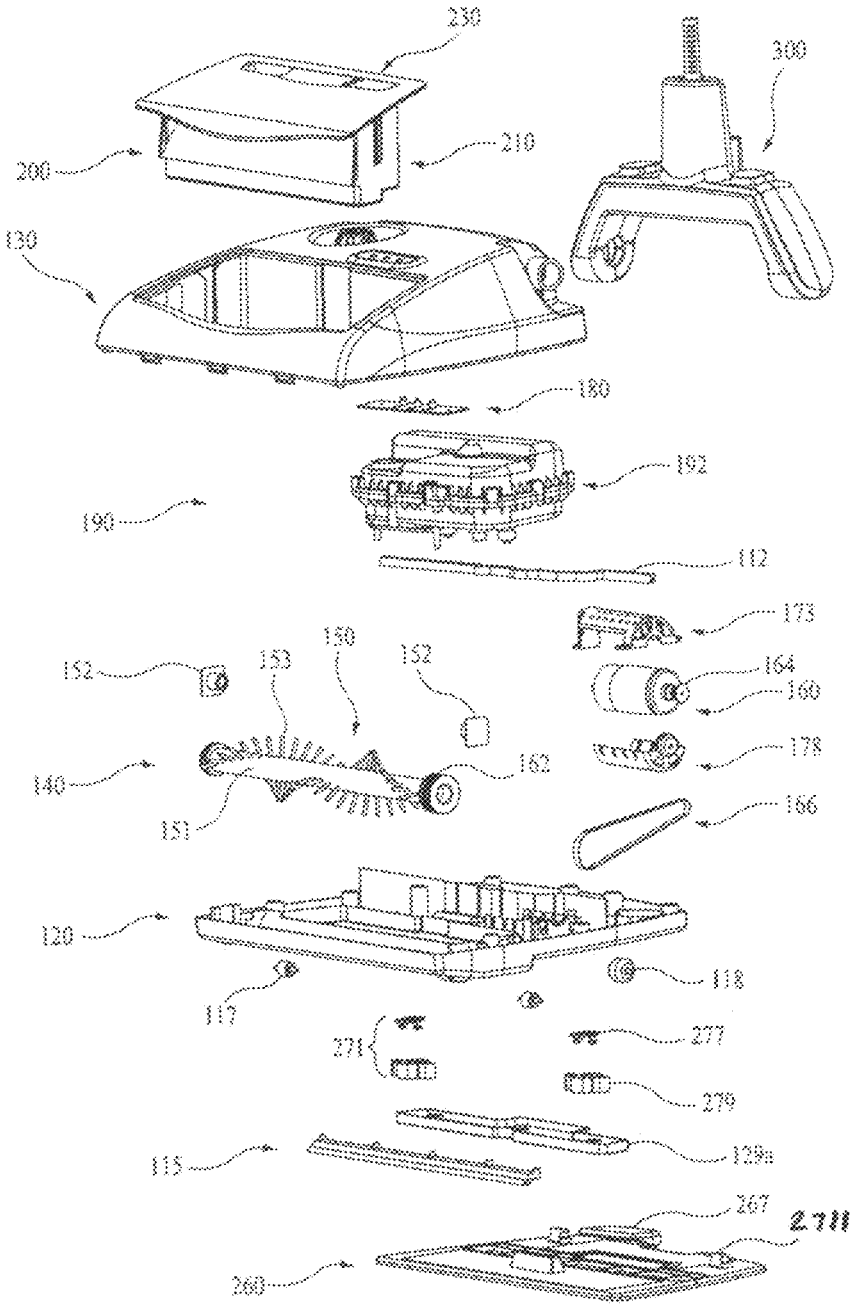
FIG. 1 is an exploded perspective view of a steam combined sweeper according to a preferred embodiment of the present invention.

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

As illustrated in FIGS. 1-4, a steam combined sweeper of this embodiment includes a base assembly 100 and a mop-stick assembly installed at the base assembly. The mop-stick assembly includes a neck assembly 300 that is pivotably connected to the base assembly 100, and a handle assembly (not shown) installed at the neck assembly 300.

The base assembly 100 includes a body 110, with a sweeping member 140 provided adjacent the front side of the body 110 and a steam generating member 190 adjacent the rear side of the body 110. The body 110 is formed by a lower casing 120 that forms an external figure, and an upper casing 130 that is coupled to the lower casing 120.

Figure 2:
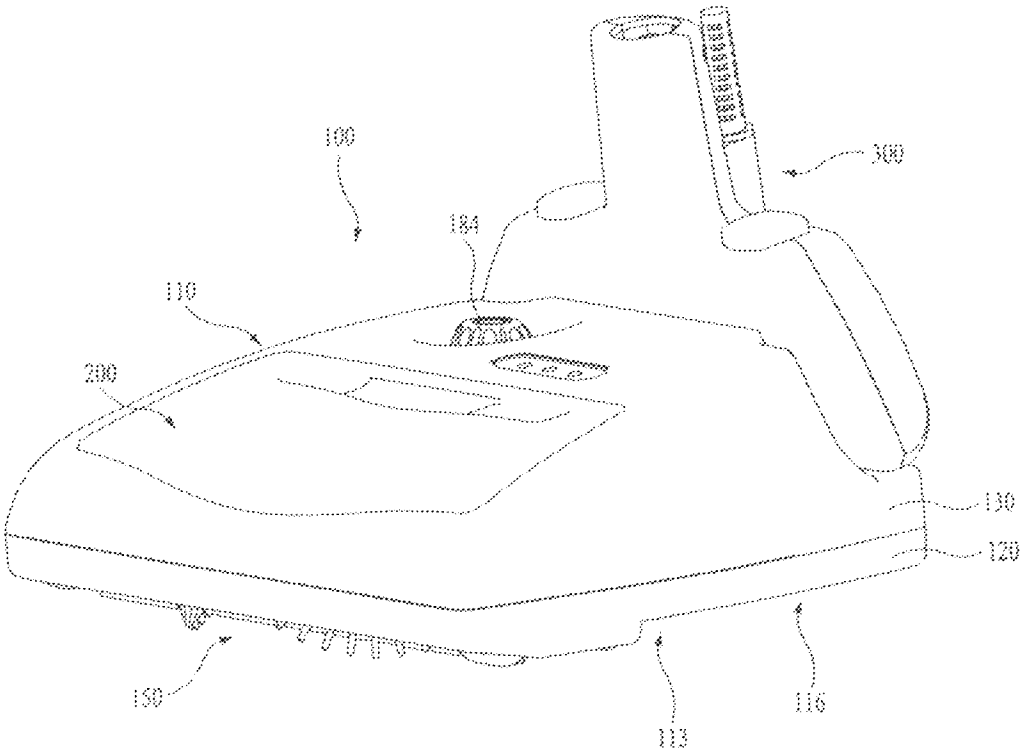
FIG. 2 shows an assembled perspective view of the steam combined sweeper of FIG. 1 without a pad tray.
Figure 3:
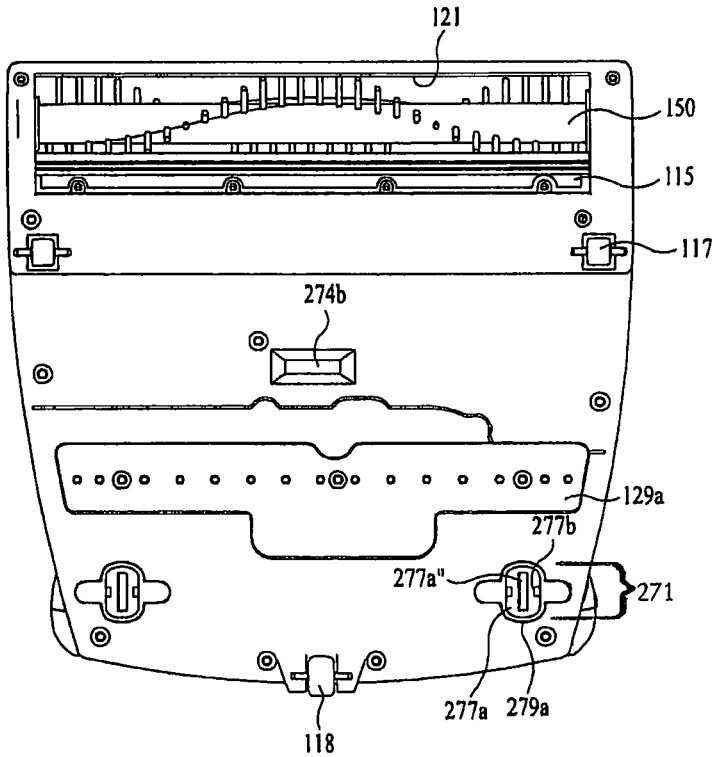
FIG. 3 shows a bottom view of FIG. 2.
Figure 4:
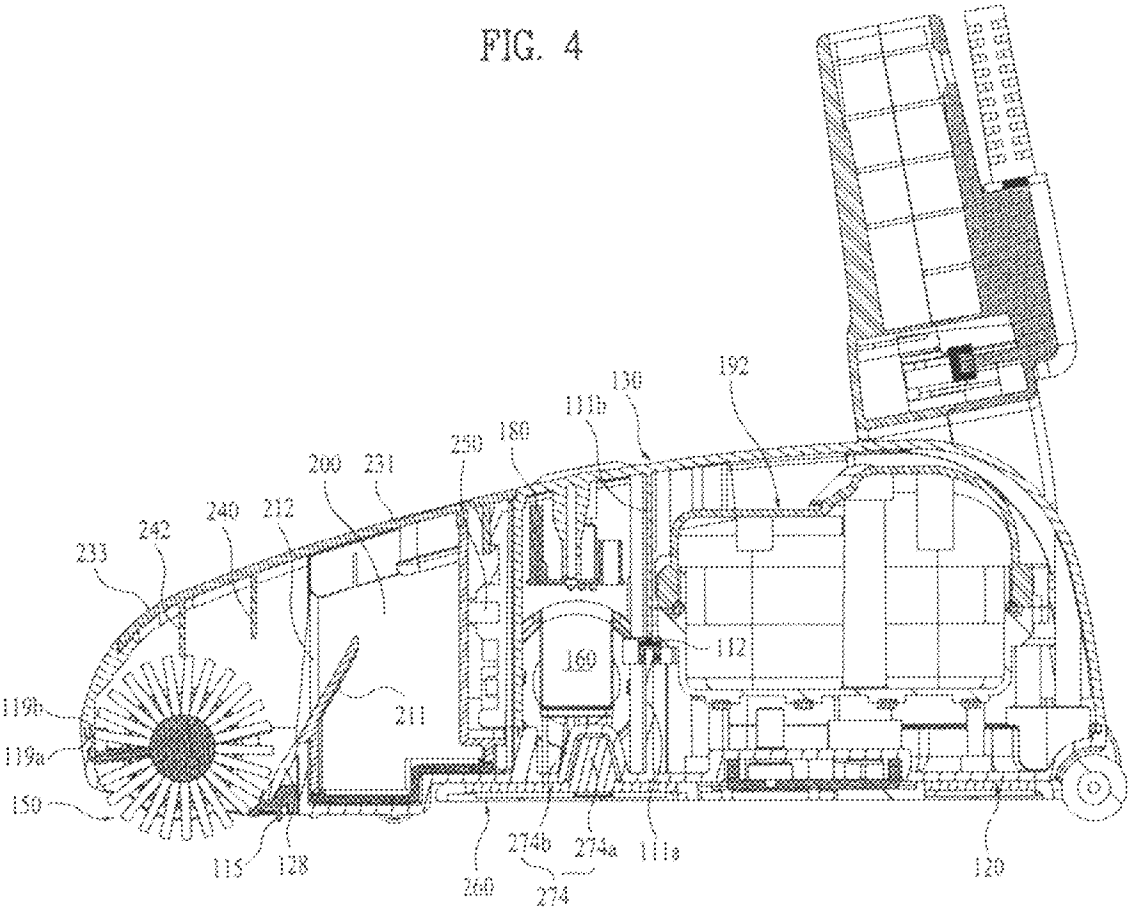
FIG. 4 is cross-sectional view of the sweeper of FIGS. 1 and 2.
Figure 5A:
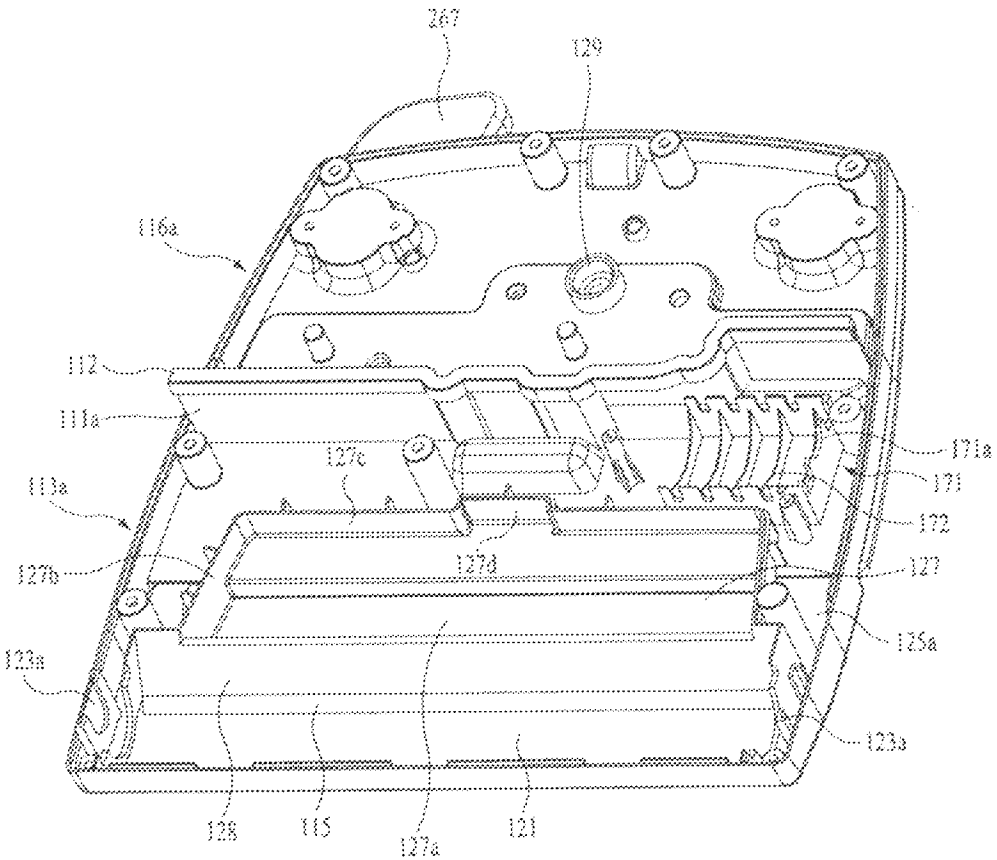
FIG. 5A shows a top perspective view of a lower casing of the sweeper of FIGS. 1 and 2.

Also, as shown in FIGS. 2, 4 and 5A, the body 110 is divided by a partition wall 111 into a sweeping mounting section 113 on which the sweeping member 140 is mounted at the front side thereof, and a steam mounting section 116 on which the steam generating member 190 is mounted at the rear side thereof. The partition wall 111 is divided into a lower partition wall 111*a* on the lower casing 120 side, and an upper partition wall 111*b* on the upper casing 130 side. A packing 112 can be installed between the lower partition wall 111*a* and the upper partition wall 111*b*.

Figure 5B:
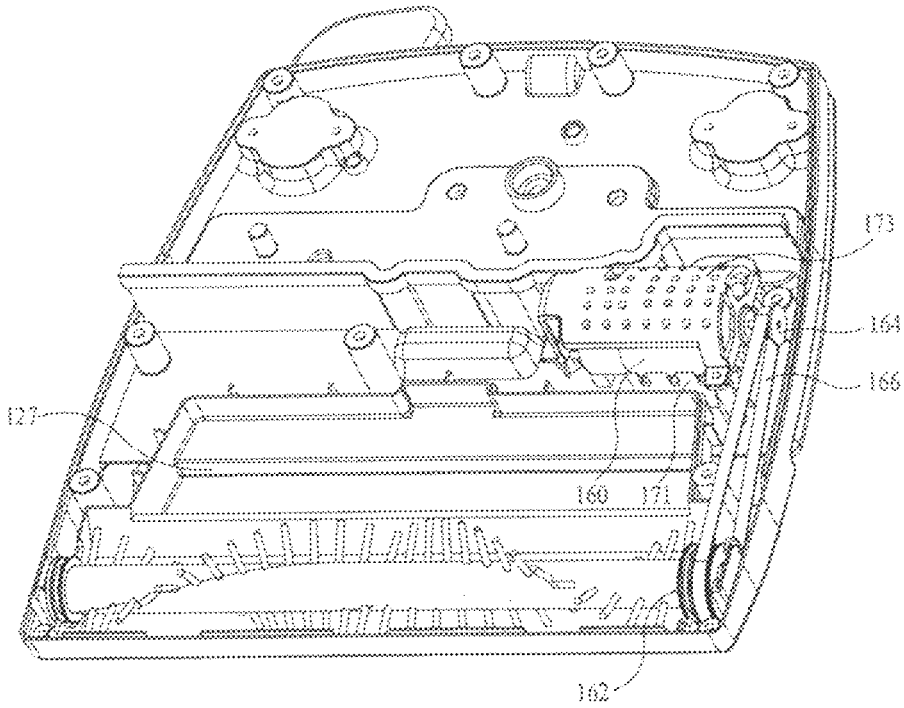
FIG. 5B shows a top perspective view of the lower casing of FIG. 5A showing how a rotary brush and a power transmission member for rotating the rotary brush are mounted.

As illustrated in FIGS. 1 and 5A, a suction port 121 where a brush 150 is disposed is formed at the front side of the sweeping mounting section 113*a* of the lower casing 120, and a lower brush holder support 123*a* is formed at both sides of the suction port 121 for supporting a holder 152 that rotably couples the brush 150. Referring also to FIG. 5B, a motor seat 171 is provided at the rear side of the sweeping mounting section 113*a* of the lower casing 120 for receiving a motor 160, and a lower passage 125*a* is formed at either the left or right side of the sweeping mounting section 113*a* of the lower casing 120 for receiving a pulley 162 of the brush 150 and a belt 166 wound around the pulley 164 of the motor 160.

Between the suction port 121 and the motor seat 171 is a dust case seat cavity 127 where a dust case 200 is seated. The dust case seat cavity 127 is defined by a stair-shaped bottom 127*a*, a front face 128 extending downwardly from an edge of the bottom 127*a*, two opposing lateral faces 127*b*, and a rear face 127*c*. The bottom 127*a* has a front side that is deeper than the lower side. The rear face 127*c* preferably has a guide groove 127*d* for guiding a locker 250 (to be described).

In particular, the front face 128 of the dust case seat cavity 127 is preferably formed to have the same slope or angle as a tilt front plate 211 (to be described) of the dust case 200. In other words, the front face 128 constitutes a primary tilt face, with the tilt front plate 211 forming one a parallel secondary tilt face that serves as the entrance of the dust case 200.

A rubber partition plate 115 can be further installed at the suction port 121 at the front face 128 to prevent scratches on the floor, or to function to block the backflow of dust particles.

The steam mounting section 116*a* of the lower casing 120 has a steam discharge port 129. A steam discharge cover 129*a* (see FIG. 3) can be fastened to the lower casing 120 to dispersedly discharge steam from the steam discharge port 129 in both lateral directions. A rear wheel 118 (see FIG. 3) can be provided at the central portion of the rear side, and left and right front wheels 117 can be also provided slightly to the rear of the suction port 121 of the lower casing 120.

Figure 6A:
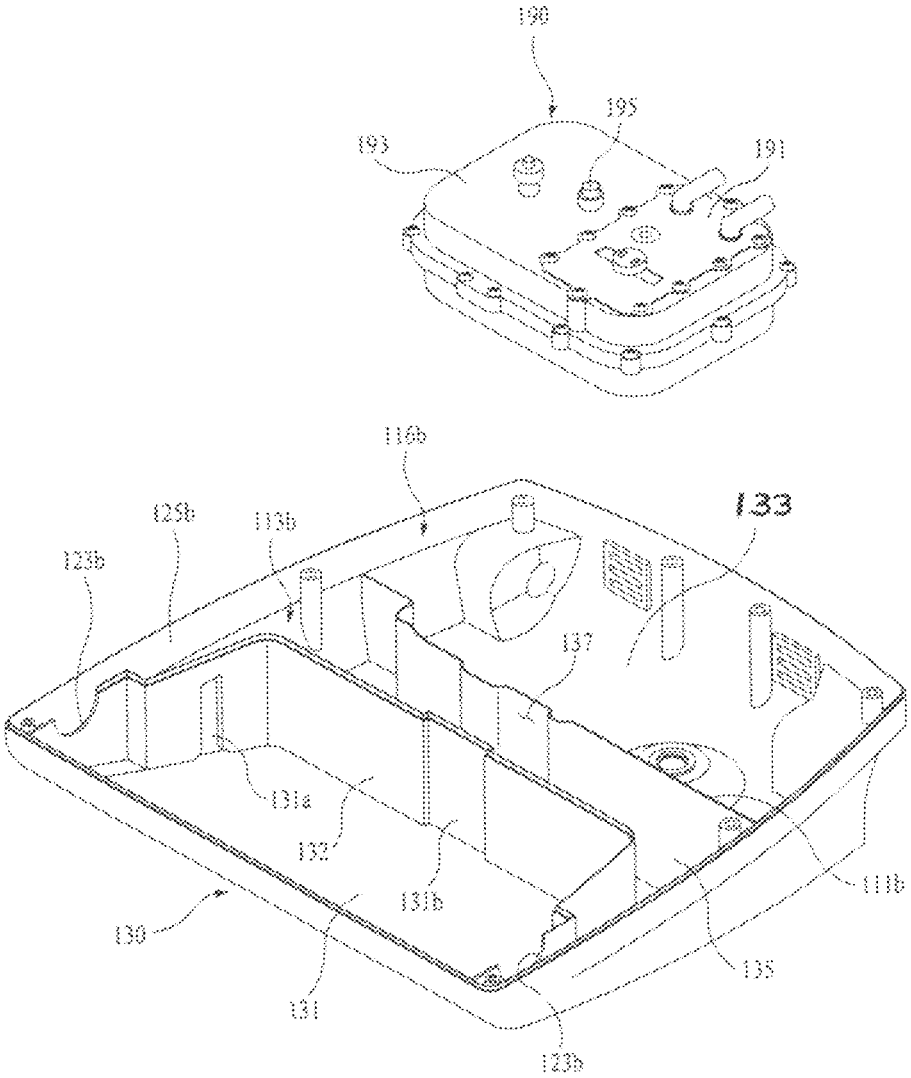
FIG. 6A is an exploded bottom perspective view of an upper casing of the sweeper of FIGS. 1 and 2.
Figure 6B:
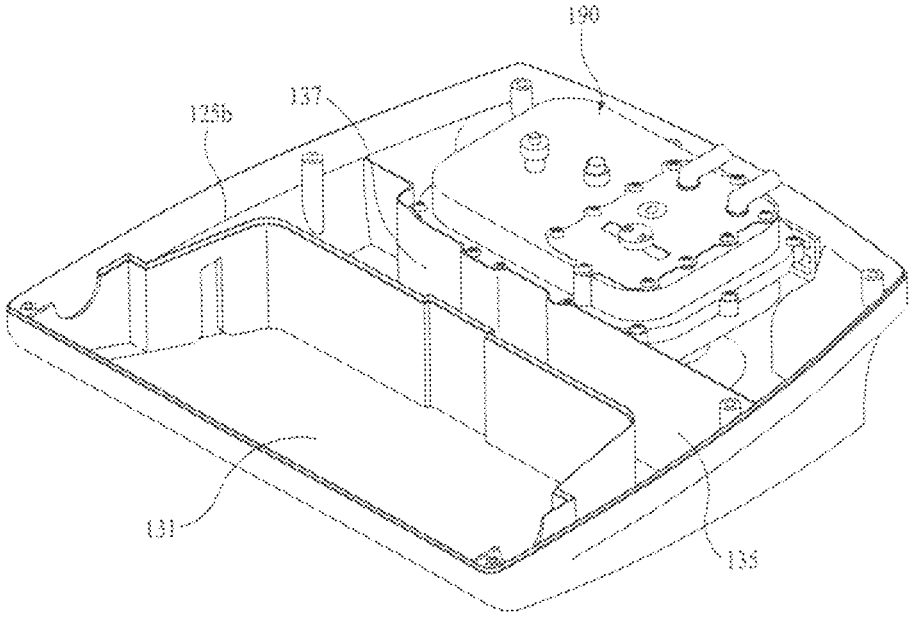

As illustrated in FIG. 6A, the sweeping mounting section 113*b* of the upper casing 130 has an open cavity 131 that corresponds to the suction port 121 and dust case seat cavity 127 of the lower casing 120. A tank mounting cavity 133 to which a tank assembly 192 is mounted is formed at the steam mounting section 116*b* of the upper casing 130. In addition, a motor mounting recess 135 and a PCB mounting recess 137 are also formed between a rear face plate 132 and the upper partition wall 111*b* of the upper casing 130. Upper brush holder supports 123*b* (for supporting the holder 152 from the top) are formed at both sides of the open cavity 131, and an upper passage 125*b* corresponding to the lower passage 125*a* is formed at either the left or right side of the sweeping mounting section 113*b* of the upper casing 130.

The lower casing 120 and the upper casing 130 are connected to each other with a latching connection, and in particular, the lower casing 120 has a latching projection 119*a* at the far front side to engage with a latch 119*b* at the far front side of the upper casing 130 (see FIG. 4), thereby enhancing the sealing force.

The sweeping member 140 is composed of a brush 150 and a rotational power transmission member for transmitting rotational power to the brush 150. The brush 150 is composed of a rotational shaft 151 and brushing filaments 153 provided on the rotational shaft 151. Opposite ends of the rotational shaft 151 are rotably supported by the respective holder 152. Each holder 152 is securely held for rotation at the brush holder supports 123*a* and 123*b*.

The rotational power transmission member is composed of a motor 160, a pulley 162 provided at one end of the rotational shaft 151, and a belt 166 wound around the pulley 164 that is installed at the rotation axis of the motor 160. The belt 166 is composed of a toothed timing belt, and the pulleys 162 and 164 are preferably toothed pulleys to be engaged with teeth.

The motor 160 is fastened to the lower casing 120 by the motor mount 170. In particular, the motor mount 170 includes a motor seat 171 formed in the lower casing 120 to allow the bottom face of the motor 160 be seated thereon, and a motor support frame 173 fastened to the lower casing 120 to surround and support the top face of the motor 160. With this configuration, the fastening work is made easier and the isolation of noise from the motor 160 can be achieved with the help of the motor seat 171 and motor support frame 173 surrounding the motor 160.

Since force is applied to one side of the motor 160 through the belt 166, a support structure for counterbalancing this force can be provided to improve the endurance of the rotation axes of the motor 160. This can be achieved by providing one fastening structure to the left side of the motor fastening frame 176 and two fastening structures to the right side of the motor fastening frame 176, as illustrated in FIG. 7.

Figure 7:
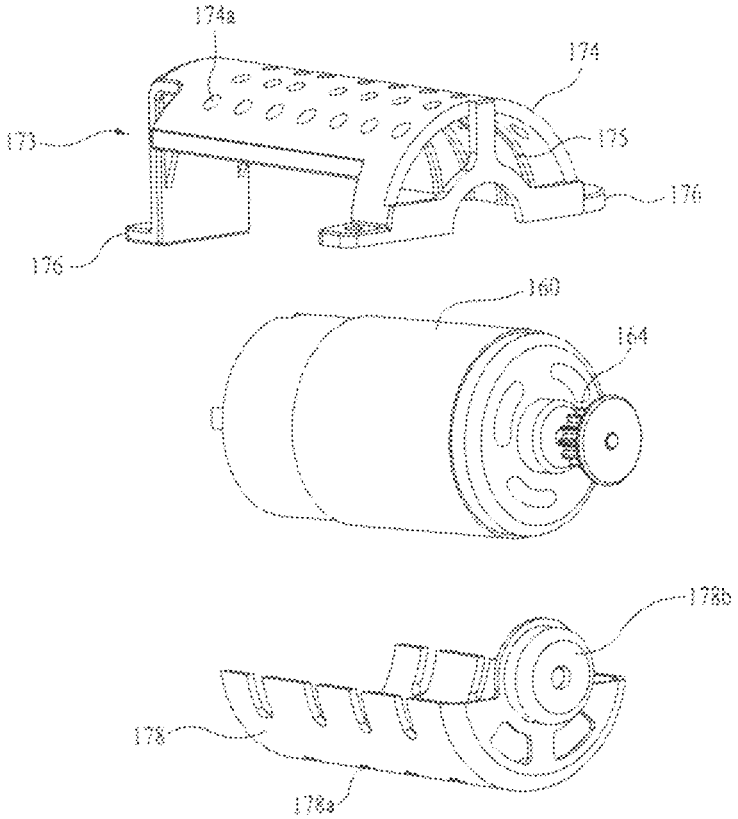
FIG. 7 is an exploded perspective view of a motor and a motor support frame of the sweeper of FIGS. 1 and 2.

Referring to FIG. 7, the motor support frame 173 includes a motor body frame 174 with heat dissipation holes 174*a*, a plurality of contact ribs 175 formed at the inner face of the motor body frame 174, and motor fastening frames 176 extending from the motor body frame 174. The contact rib 175 has a band shape along its circumference to form a line contact with the outer peripheral face of the motor 160, and the heat dissipation holes 174*a* are preferably formed in the motor body frame 174 between the contact ribs 175 to dissipate heat generated by the motor 160. The motor fastening frames 176 are formed at both sides of the motor support frame 173, which are then fastened and secured to the lower casing 120 by screws.

Referring to FIG. 5A, the motor seat 171 is preferably composed of a plurality of base ribs 172 for holding up or bracing the bottom face of the motor 160. A partial motor support 171*a* is preferably formed at one side of the motor seat 171 so as to support one end (near the rotation axis) of the motor 160.

Referring back to FIG. 7, a dustproof pad 178 with heat dissipation holes 178*a* is preferably interposed between the base ribs 172 and the bottom face of the motor 160, and preferably interposed between the motor seat 171 and the base ribs 172. A support cap 178*b* that is supported onto one end of the motor 160 is formed at one side of the dustproof pad 178 in such a way that the support cap 178*b* may be interposed between the partial motor base 171*a* and the one end of the motor 160 to absorb vibration noises.

Figure 8:
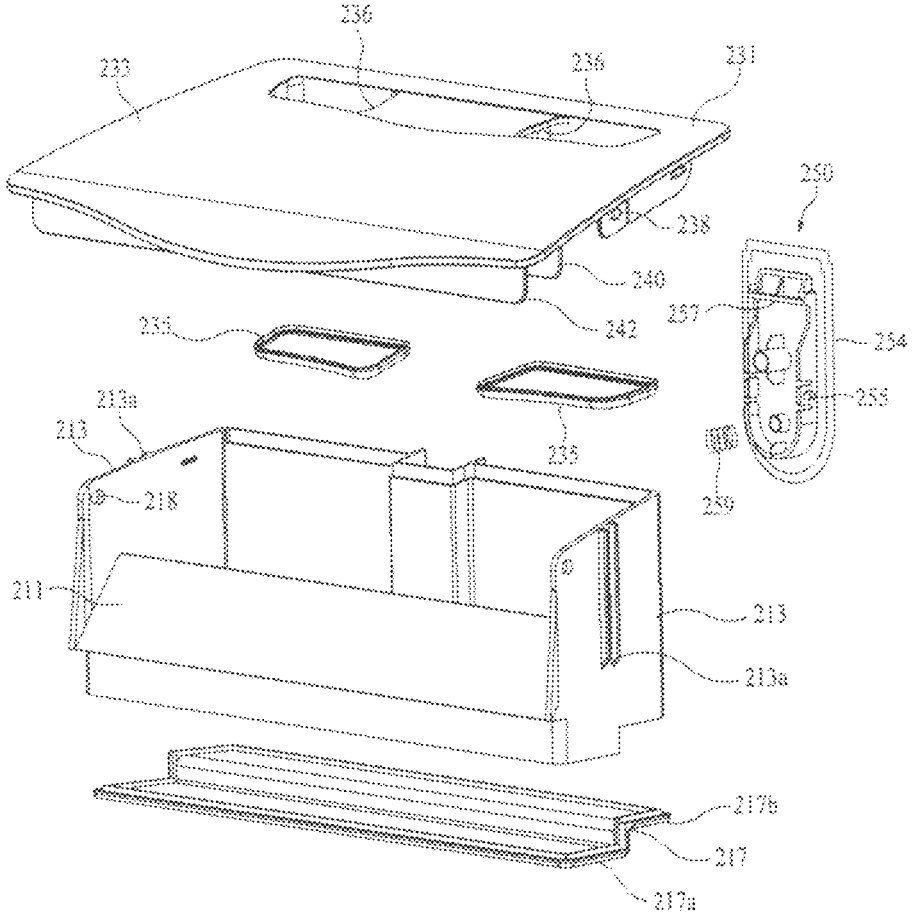
FIG. 8 is an exploded perspective view of a dust case for the sweeper of FIGS. 1 and 2.

The dust case 200 that is housed in the open cavity 131 and dust case seat cavity 127 includes a casing 210 and a cover 230 for opening/closing the top of the casing 210, as shown in FIGS. 1 and 8. An inlet 212 (see FIG. 4) through which dust particles flow inside is formed at the front face of the casing 210. The casing 210 is composed of a front plate (or wall) 211, lateral plates (or walls) 213, a back plate (or wall) 215 and a bottom plate (or wall) 217, and serves as an outlet for cleaning dust particles piled up at the open top portion. As explained earlier, the front plate 211 is formed of a tilted (angled) front plate 211 in an inclined state, thereby serving as a dustpan, with the inlet 212 arranged at the upper side of the tilted front plate 211. Guide projections 213*a* are formed on both lateral plates 213, and guide grooves 131*a* (see FIG. 6A) are formed on both lateral plates of the open cavity 131. The bottom plate 217 has a stepped configuration, with a rear portion 217*b* that is raised by a step from a front portion 217*a*. The bottom plate 217 is adapted to be seated on the stair-shaped bottom 127*a* described above (see FIG. 5A). Since the front portion 217*a* of the bottom plate 217 is lower than the rear portion 217*b*, it allows the casing 210 to have a deeper front end, thereby providing increased volume in the casing 210 to compensate for any dust-collection (volume) capacity that has been reduced by the height of the inlet 212 that may have taken up the front plate 211.

Figure 9A:
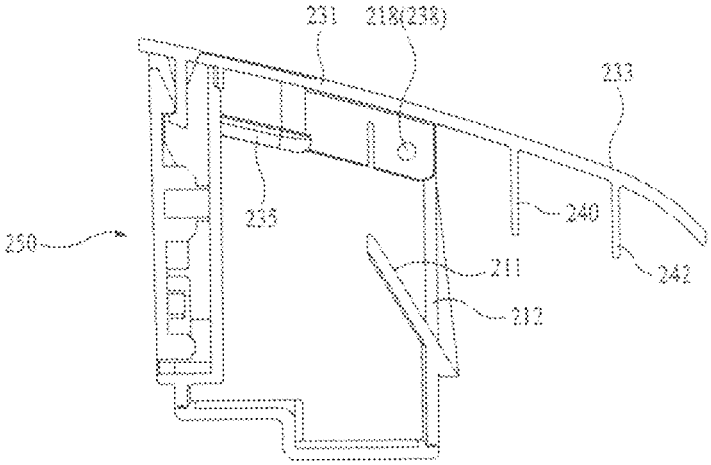
FIG. 9A and FIG. 9B show cross-sectional views of the dust case in its open and closed state, respectively.

The cover 230 is preferably composed of a first cover portion 231 for covering the top of the casing 210 and a second cover portion 233 extending in the forward direction from the first cover portion 231. When the dust case 200 is placed in the open cavity 131 as shown in FIGS. 4 and 9A, the second cover portion 233 covers the top of the brush 153. The cover 230 is preferably coupled to the casing 210 by hinge shafts 218 and 238, with the hinge shaft 238 of the cover 230 fitted into a hinge opening 218 of the casing 210 for pivoting motion. The hinge shaft 238 is arranged between the first cover portion 231 and the second cover portion 233, and the hinge opening 218 is preferably formed at the lateral plates 213 near the inlet 212.

Figure 9B:
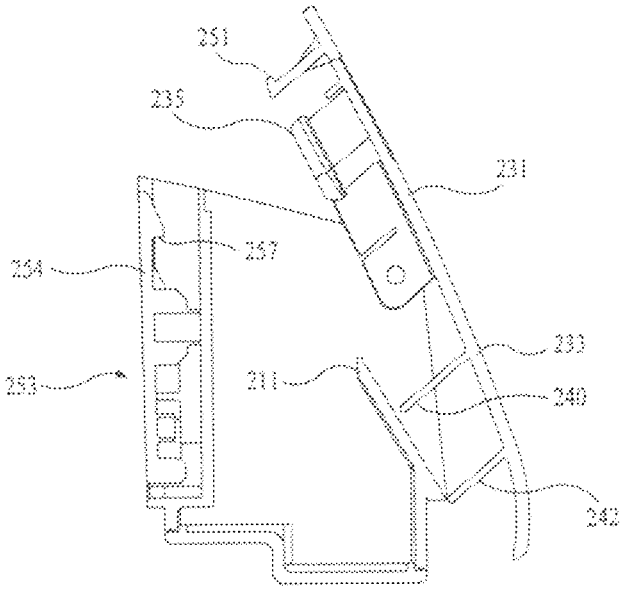
Figure 10:
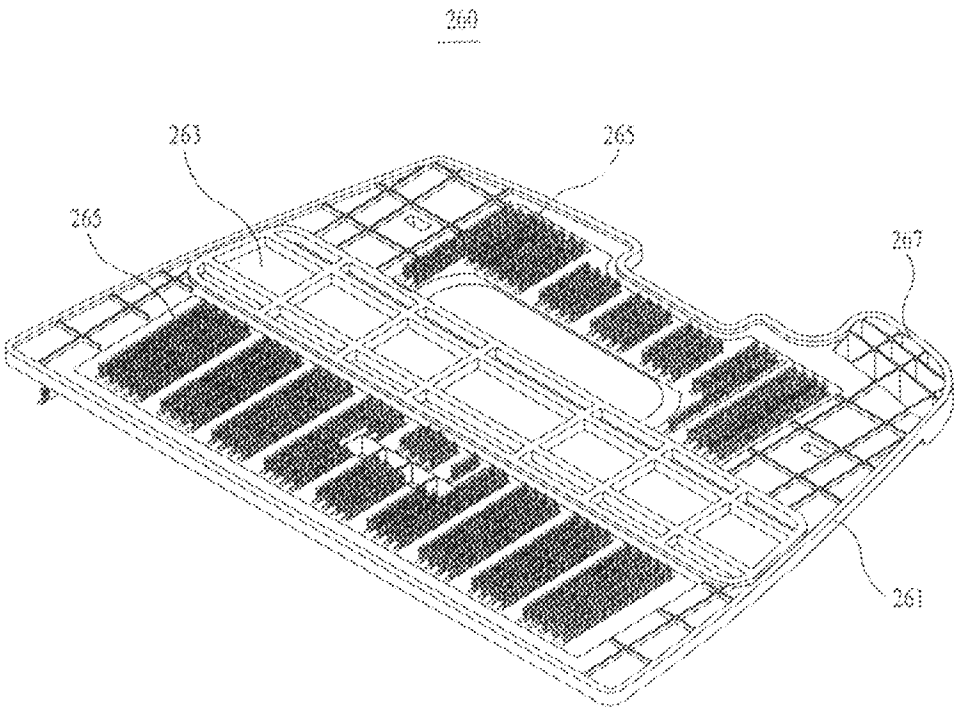
FIG. 10 and FIG. 11 are bottom and top perspective views, respectively, of a pad tray for the sweeper of FIGS. 1 and 2.

Because of the locations of the hinge shaft 238 and hinge opening 218, when the cover 230 is moved from a closed state as in FIG. 9A into an open state as in FIG. 9B, the first cover portion 231 leaves the top of the casing 210 open, while the second cover portion 233 contacts the tilted front plate 211 and covers the inlet 212.

Conversely, when the first cover portion 231 is closed, the second cover portion 233 opens the inlet 212, so that the cover 230 pivots like a seesaw. As a result, even when the casing 210 and the second cover portion 233 is turned upside down to empty dust particles, the dust particles do not sneak into the inlet 212, thereby helping to maintain a clear appearance of the casing 210 and the cover 230. Since dust particles are discharged and emptied through the top, the collected dust does not leak except through the inlet 212, such that the dust case seat cavity 127 remains clean, compared a the conventional dust case which is usually opened/closed through the bottom face, where the collected dust may sneak in through any crack and then be piled up in the dust case seat cavity.

As illustrated in FIGS. 4 and 8, a safety bar 240 is extends downwardly from the bottom face of the second cover portion 233. The safety bar 40 can be formed as a rib protruding in the lateral direction so as to prevent dust particles gathered by the rotation of the brush 150 from rebouncing (the backflow phenomenon). Accordingly, the dust particles having collided with the safety bar 240 either reenter the inlet 212 or fall between the inlet 212 and the brush 150, consequently improving the sweeping efficiency.

Moreover, as illustrated in FIGS. 4 and 8, it is preferable (though optional) to have a secondary safety bar 242 arranged farther to the front than the safety bar 240 on the bottom face of the second cover portion 233. This secondary safety bar 242 serves as a duster for the brush 153 to further improve the sweeping efficiency of the brush 153. When the safety bar 240 or the secondary safety bar 242 are formed in this way, these safety bars 240 and 242 serve to block the inlet 212 as they come in contact with the tilted front plate 211.

In addition, the second cover portion 233 preferably has a see-through cover 235 for a user to be able to look at the inside of the casing 210. The see-through cover 235 can be inserted into a part that is protruded downwardly from the first cover portion 231, and a handle bar 236 (which can be grasped with fingers) can be formed at its lateral face.

Moreover, a locker 250 for locking/unlocking the cover 230 into/from the casing 210 can be provided. The locker 250 is composed of a locking projection 251 (see FIG. 9B) formed at the cover 230, and an unlocking element 253 for locking/unlocking the locking projection 251. The unlocking element 253 is composed of an operational piece 254, a hinge shaft 255 for allowing the operational piece 254 to be pivotable about a hinge groove (not shown) of the back plate 215, a locking arm 257 formed above the operational piece 254 around the hinge shaft 255 so as to catch the locking projection 251 thereon, and a spring 259 arranged below the operational piece 254. Thus, when the operational piece 254 at the side of the spring 259 is pressed, the locking arm 257 starts pivoting and the locking projection 251 is then unlocked. On the other hand, when the locking projection 251 is pressed inwardly (i.e., when the cover 230 is pressed into the casing 210), it pushes the top face of the locking arm 257 and engages with the pivoting, operational piece 254 into an interlocked state. Because the locker 250 protrudes from the back plate 215, a guide groove 131*b* can be provided at the rear face plate 132 to receive and guide the locker 250 (see FIG. 6A).

The steam generation member 190 is composed of a heater 191, a tank 193 in which water comes in contact with the heater 191 to be converted into steam, and a connection tube 195 for delivering steam generated from the tank 193 to the steam discharge port 129 (see FIG. 5A). Water is fed into the tank 193 via a cap 184. Referring to FIG. 4, a PCB 180 is provided in a space between the partition wall 111*b* and the rear face plate 132. The PCB 180 functions to control operations of the steam generating member 190 and sweeping member 140.

As illustrated in FIGS. 10-13, the pad tray 260, which is attachable/detachable to the attachment/detachment member, is secured to the bottom face of the lower casing 120. The pad tray 260 is detached when the sweeper is cleaning a carpet or similar tasks, and is attached when the sweeper is used for cleaning a non-carpeted floor using steam. The pad tray 260 is composed of a tray board 261, withdrawal openings 263 formed in the tray board 261 that are in communication with the steam discharge port 129 (see FIG. 5A), and pad attachment protrusions 265 molded at the front side, back side or both front and back sides around the withdrawal openings 263. The pad attachment protrusions 265 can be made of soft plastic materials (PP or PC based materials) to help the VELCRO™ on the pad to be easily attached thereto or detached therefrom. In general, when a soft plastic material is used as a single product (i.e., it is either attached or detached as in this embodiment), its warping tendency makes it difficult to be attached to the bottom face of the lower casing 120. This is because the conventional steam cleaner is fastened and secured to the upper casing 130; although the pad attachment protrusions 265 are molded with a soft plastic material onto the lower casing 120, the upper casing 130 does not undergo any deformation or warping.

Figure 12:
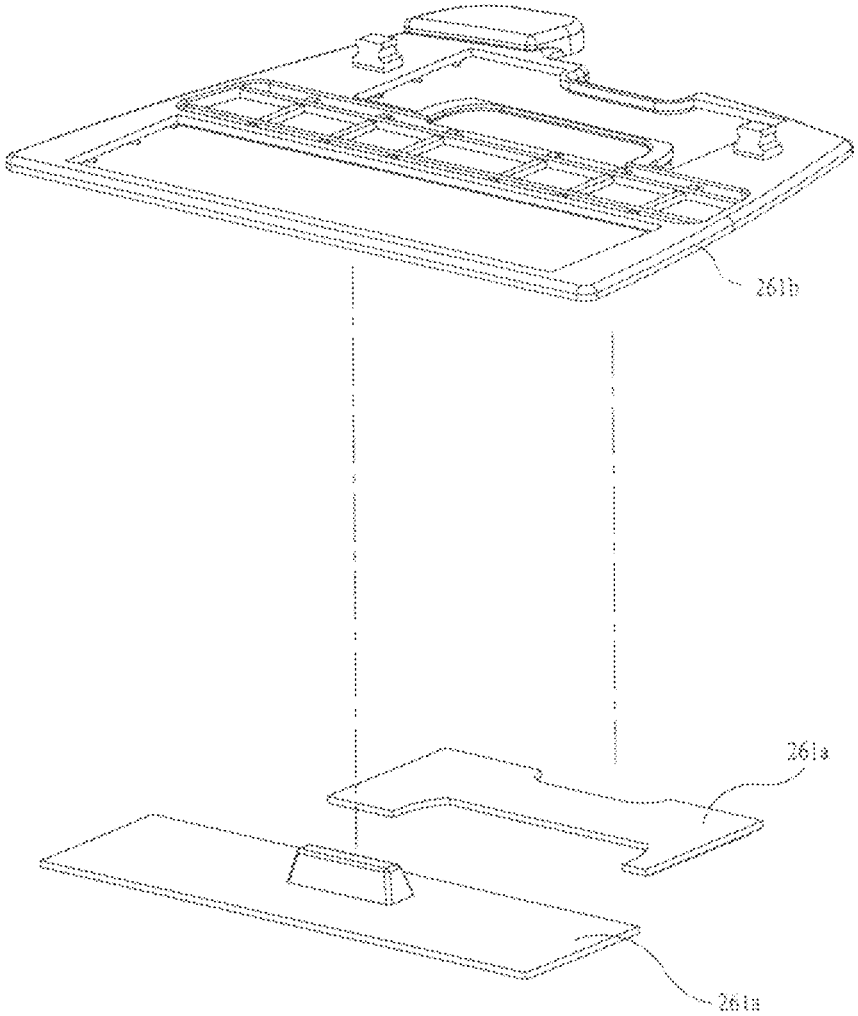
FIG. 12 is a perspective view showing a manufacturing process of the pad tray of FIG. 11.
Figure 13:
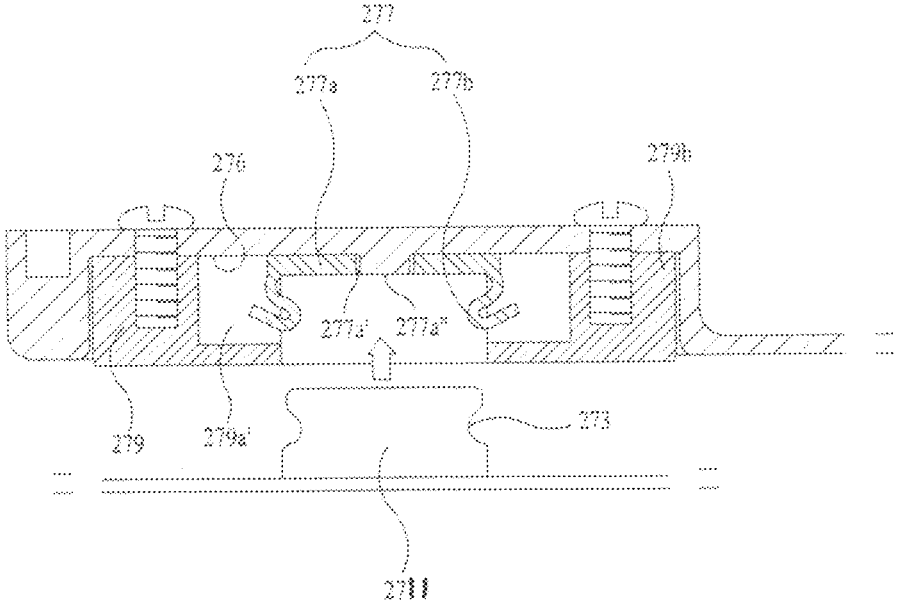
FIG. 13 shows a cross-sectional view of the pad tray and an attachment/detachment member of the lower casing.
Figure 14:
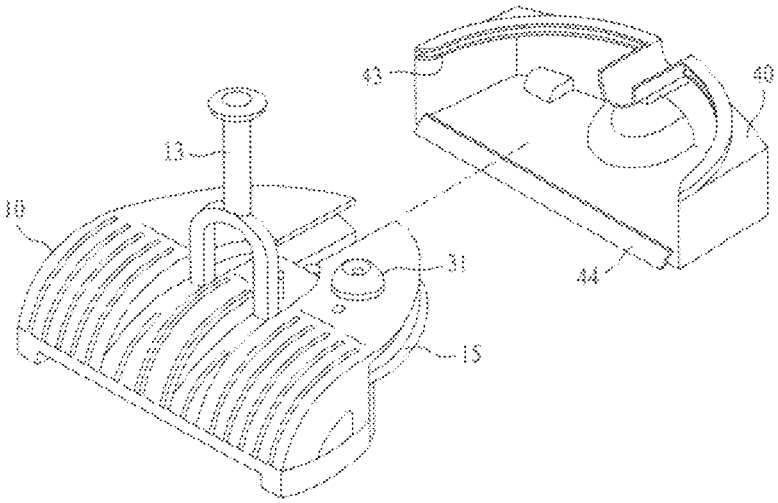
FIG. 14 is an exploded perspective view of a conventional sweeper.
Figure 15:
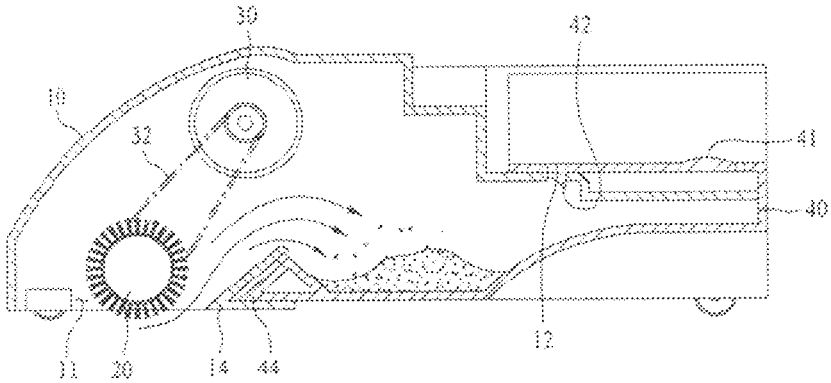
FIG. 15 is an assembled cross-sectional view of the conventional sweeper of FIG. 14.
Figure 16:
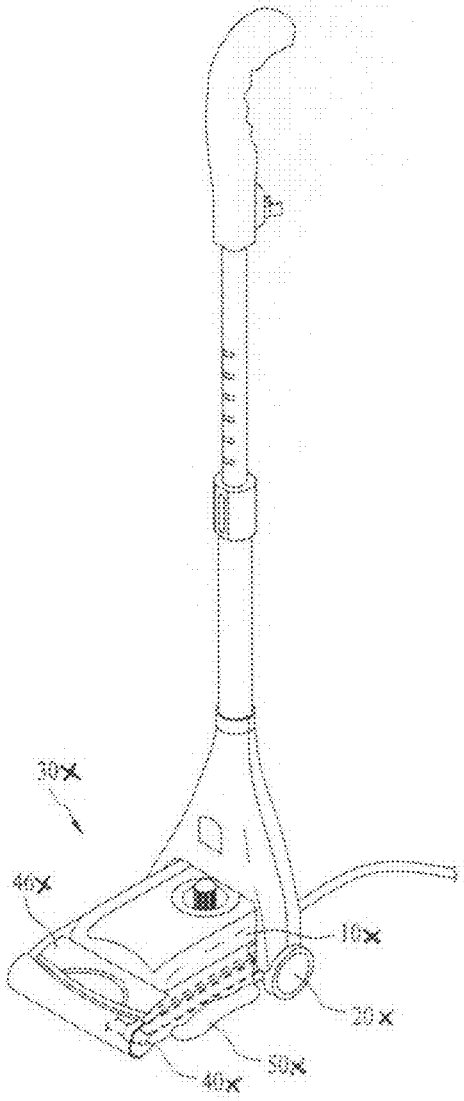
FIG. 16 is a perspective view of another conventional steam combined sweeper.
Figure 17:
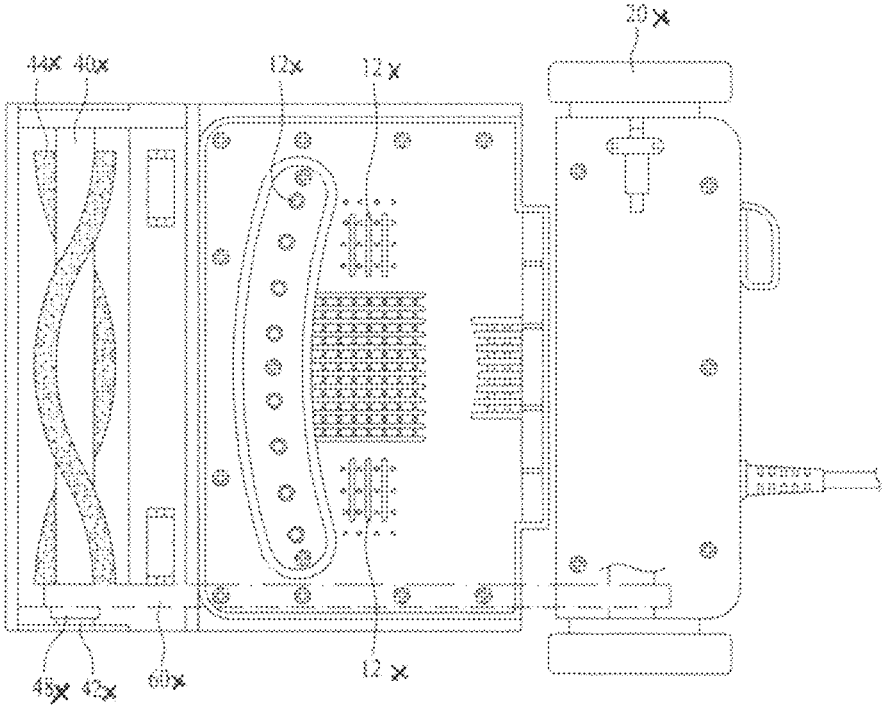
FIG. 17 is a bottom view of FIG. 16.

In conventional applications, a PP plastic resin is normally used for the VELCRO™, but it can be easily deformed by heat after manufacturing by mould. Therefore, in this embodiment, a board 261*a* with soft pad attachment protrusions 265 as shown in FIG. 12 is molded as a first tray board using a heat-resistant soft plastic material, and then the board 261*a* with pad attachment protrusions 265 is inserted into a mold to form a reinforced tray board 261*b* as a second tray board that is more sensitive to heat than the first tray board and contains hard plastic materials (e.g., PP or PC based materials with a small amount of glass fiber), thereby forming a double injection. The resin for the tray board 261*b* is a PC, which is strong enough to keep its shape under heat or other related circumstances. The second tray board 261*b* of FIG. 12 is not necessarily manufactured separately, yet it is provided here for better understanding. As such, even though the pad tray 260 is a single product, the reinforced tray board 261*b* holds up the board 261*a* with pad attachment protrusions 265 to maintain its flat shape.

The attachment/detachment member is composed of a first attachment/detachment portion 2711 formed on the pad tray 260, and a second attachment/detachment portion 271 installed at the lower casing 120. The first attachment/detachment portion 2711 is composed of an attachment/detachment groove 273 formed at the lateral face of a protrusion 272 that extends upwardly from the top face of the pad tray 260. The second attachment/detachment portion is composed of an elastic locking element 277 received by a recess 276 formed in the bottom face of the lower casing 120, and a support element 279 for supporting the elastic locking element 277. The elastic locking element 277 is composed of a bottom sheet 277*a* placed at the bottom of the recess 276, and an elastic locking piece 277*b* that can be elastically deformed in a cantilever shape from the bottom sheet 277*a*. A slot 277*a*' is formed at the center of the bottom sheet 277*a* for receiving a slot projection 277*a*" formed at the recess 276. The support element 279 is composed of a support piece 279*a* (see FIG. 3) for pressing the bottom sheet 277*a* in the way of support, and a fastening piece 279*b* that is fastened and secured to the lower casing 120 for supporting the support piece 279*a*. When the support piece 279*a* has a hollow shape, a disposition recess 279*a*' where the elastic locking piece 277*b* is movably disposed is preferably formed at the support piece 279*a*.

Figure 11:
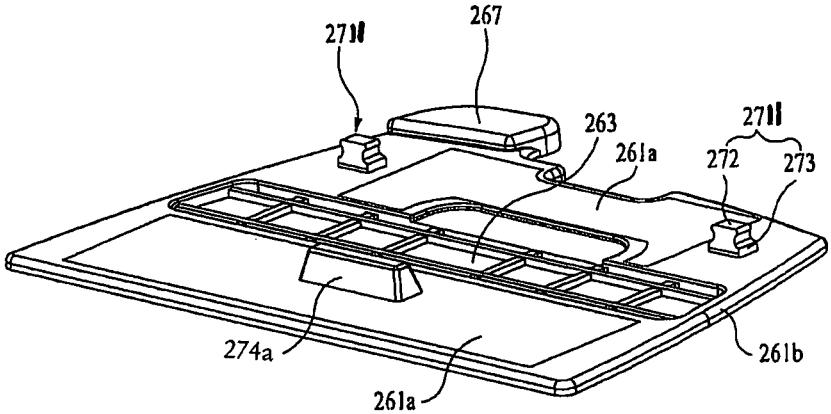

As the first and second attachment/detachment portions are placed behind the pad tray 260 and lower casing 120, it is preferable to have a third attachment/detachment portion 274 additionally in front of the pad tray 260 and lower casing 120 (see FIGS. 4 and 11). The third attachment/detachment portion 274 is composed of a boss 274*a* formed at the top face of the pad tray 260, and an insertion recess 274*b* into which the boss 274*a* is inserted. The boss 274*a* and the insertion recess 274*b* are preferably in the form of a solid trapezoid facilitating easy attachment/detachment.

The pad tray 260 also has a foot press 267 at a rear side so that the user can step thereon (or use a hand to press) from a standing position.

The present invention can be applied to a reservoir-type steam combined sweeper (in case a steam generating member is installed at the body), to an injection-type steam combined sweeper (in case a steam generating member is installed at the mop-stick), or to a gravity-operated steam combined sweeper (in case a steam generating member is installed at either the body or the mop-stick).

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A floor cleaner having a base assembly, the base assembly comprising:

a body having a front side and a rear side, the body composed of an upper casing and a lower casing, with the lower casing having a bottom face;

a sweeping member mounted on the front side of the body;

a steam generating member mounted at the rear side of the body;

a pad tray with protrusions formed thereon to which a pad is attached, wherein the protrusions are made of a material that is softer than the material of the pad tray and wherein the pad tray comprises a first tray board with protrusions formed thereon to which a pad is attached, and a second tray board formed by insert injection of the first tray board; and an attachment/detachment member that attaches and detaches the pad tray to and from the bottom face of the lower casing.

2. The floor cleaner of claim 1, wherein the first tray board is a soft plastic board, and the second tray board is composed of a plastic which is harder than the first tray board.

3. A floor cleaner having a base assembly, the base assembly comprising:

a body having a front side and a rear side, the body composed of an upper casing and a lower casing, with the lower casing having a bottom face;

a sweeping member mounted on the front side of the body;

a steam generating member mounted at the rear side of the body;

a pad tray with protrusions formed thereon to which a pad is attached, the protrusions made of a material that is softer than the material of the pad tray; and an attachment/detachment member that attaches and detaches the pad tray to and from the bottom face of the lower casing, wherein the attachment/detachment member is composed of a first attachment/detachment portion protruding from the pad tray so as to form a locking groove on a lateral face, and a second attachment/detachment portion mounted in a recess on the bottom face of the lower casing and then locked into the locking groove, and wherein the second attachment/detachment portion includes an elastic locking element received by the recess and locked into the locking groove, and a support element fastened to the lower casing to support the elastic locking element.

4. The floor cleaner of claim 1 wherein the attachment/detachment member is a first attachment/detachment member, the floor cleaner further comprising including a second attachment/detachment member that attaches and detaches the pad tray to and from the bottom face of the lower casing.

5. The floor cleaner of claim 4, further comprising a third attachment/detachment member that attaches and detaches the pad tray to and from the bottom face of the lower casing.

6. The floor cleaner of claim 1 further comprising a foot press provided on the pad tray adjacent the rear side of the body.

* * * * *